US009785066B2

(12) United States Patent
Yoshida et al.

(10) Patent No.: US 9,785,066 B2
(45) Date of Patent: Oct. 10, 2017

(54) TONER INCLUDING MICROCAPSULES THAT CONTAIN A FRAGRANT MATERIAL

(71) Applicants: KABUSHIKI KAISHA TOSHIBA, Tokyo (JP); TOSHIBA TEC KABUSHIKI KAISHA, Tokyo (JP)

(72) Inventors: Maiko Yoshida, Mishima Shizuoka (JP); Satoshi Araki, Mishima Shizuoka (JP); Taishi Takano, Sunto Shizuoka (JP); Takashi Urabe, Sunto Shizuoka (JP); Junichi Ishikawa, Mishima Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/141,533

(22) Filed: Apr. 28, 2016

(65) Prior Publication Data

US 2016/0327880 A1 Nov. 10, 2016

(30) Foreign Application Priority Data

May 8, 2015 (JP) ..... 2015-095918

(51) Int. Cl.

| | |
|---|---|
| ***G03G 9/08*** | (2006.01) |
| ***G03G 9/093*** | (2006.01) |
| ***G03G 9/097*** | (2006.01) |
| ***G03G 9/09*** | (2006.01) |
| ***G03G 15/08*** | (2006.01) |

(52) U.S. Cl.

CPC ..... *G03G 9/0825* (2013.01); *G03G 9/0804* (2013.01); *G03G 9/0821* (2013.01); *G03G 9/093* (2013.01); *G03G 9/097* (2013.01); *G03G 9/0926* (2013.01); *G03G 9/09307* (2013.01); *G03G 15/08* (2013.01)

(58) Field of Classification Search

CPC .... G03G 9/0821; G03G 9/0825; G03G 9/093; G03G 9/09307; G03G 9/097

USPC ..... 430/110.2

See application file for complete search history.

(56) References Cited

U.S. PATENT DOCUMENTS

| | | | | |
|---|---|---|---|---|
| 9,291,928 | B2 | 3/2016 | Yoshida et al. | |
| 2015/0132697 | A1* | 5/2015 | Yoshida | G03G 9/0825 430/109.1 |

FOREIGN PATENT DOCUMENTS

| | | | |
|---|---|---|---|
| DE | 202011105001 | U1 | 11/2011 |
| JP | S62141567 | A | 6/1987 |
| JP | H0216572 | A | 1/1990 |
| JP | H0348861 | A | 3/1991 |
| JP | H05214283 | A | 8/1993 |

(Continued)

OTHER PUBLICATIONS

Extended European Search Report dated Oct. 5, 2016, mailed in counterpart European Application No. 16167291.0, 6 pages.

*Primary Examiner* — Mark A Chapman

(74) *Attorney, Agent, or Firm* — Patterson & Sheridan, LLP

(57) ABSTRACT

A toner includes a plurality of toner particles containing a binder resin and one or more microcapsules that contain a fragrant material. A ratio of a number of toner particles that contain at least one microcapsule in a region from a surface thereof to 1 μm in depth with respect to a total number of toner particles in the region is equal to or greater than 60%.

20 Claims, 3 Drawing Sheets

(56) References Cited

FOREIGN PATENT DOCUMENTS

| | | | |
|---|---|---|---|
| JP | 2003-173041 | A | 6/2003 |
| WO | 0079346 | A1 | 4/2000 |

* cited by examiner

TONER INCLUDING MICROCAPSULES THAT CONTAIN A FRAGRANT MATERIAL

CROSS-REFERENCE TO RELATED APPLICATION

This application is based upon and claims the benefit of priority from Japanese Patent Application No. 2015-095918, filed May 8, 2015, the entire contents of which are incorporated herein by reference.

FIELD

Embodiments described herein relate generally to a toner, in particular, a toner including microcapsules that contain a fragrant material.

BACKGROUND

A unique image forming material is needed in fields of cards, pamphlets, direct mails, and the like. For example, ink comprising microcapsules that contain a fragrance ingredient is used for an image forming material for offset printing, screen printing, or the like. An image formed with such ink can emit a scent.

Also for electrophotographic printing, toner containing a fragrance ingredient or a toner produced through a fragrance treatment process is proposed. Such toner is produced to offset an unpleasant odor generated during the image forming process. It would be desirable that the fragrant effect continues after the image forming.

DETAILED DESCRIPTION

Figure 1A:
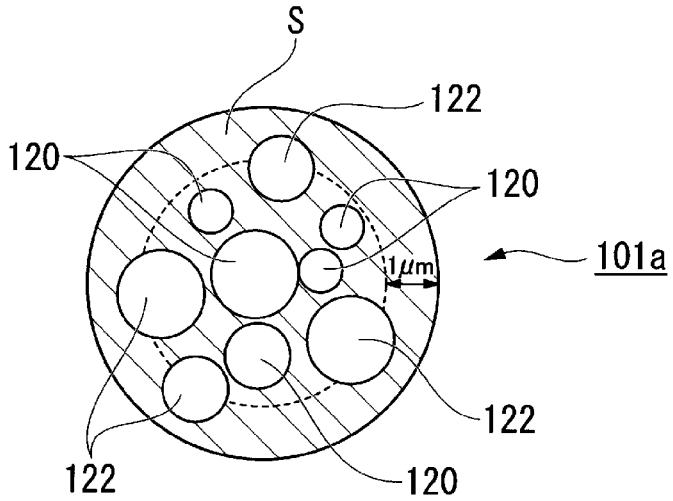
FIGS. 1A to 1C schematically illustrate a cross-section of a toner particle of a type different from each other, which is observed by a TEM.

One or more embodiments provide toner that maintains a scent emitted therefrom for a long period of time, an image forming apparatus, and a method of producing the toner.

According to an embodiment, a toner includes a plurality of toner particles containing a binder resin and one or more microcapsules that contain a fragrant material. A ratio of a number of toner particles that contain at least one microcapsule in a region from a surface thereof to 1 μm in depth with respect to a total number of toner particles in the region is equal to or greater than 60%.

Hereinafter, a toner according to an embodiment will be described.

The toner according to the embodiment includes a group of toner particles. Each of the toner particles contains a binder resin and one or more microcapsules including a fragrance ingredient.

The group of toner particles will be described below in detail.

The group of toner particles according to the embodiment is a group of toner particles which contains one or more microcapsules and a binder resin.

The group of toner particles includes toner particles in which one or more microcapsules are positioned in a region from a surface to 1 μm in depth, in an amount of 60% by number or more. The group of toner particles preferably includes toner particles in which one or more microcapsules are positioned in the region from the surface to 1 μm in depth, in an amount of 70% by number or more, and more preferably 80% by number or more. The group of toner particles may include toner particles so as to be 100% by number.

The percentage by number of toner particles in which one or more microcapsules are positioned in the region from the surface to 1 μm in depth is measured as follows.

Toner particles are embedded in an epoxy resin, and ultrathin slices of the toner particles having a thickness of 100 nm are manufactured by using an ultramicrotome (manufactured by LEICA Corporation). The obtained slices are observed by a transmission electron microscope (TEM) ("JEM-1010" manufactured by Jeol Ltd.), and image analysis is performed. The number of microcapsules positioned in the region from the surface of a toner particle to 1 μm in depth is counted based on a result of the image analysis. The image analysis is performed by using an image processing analyzer "Luzex III" (manufactured by Nireco Corporation).

100 toner particles which are randomly selected are subjected to the image analysis, and a percentage (percentage by number) of toner particles in which one or more microcapsules are positioned in the region from the surface of the toner particle to 1 μm in depth is calculated.

In a producing method of the toner particles, the percentage of toner particles in which one or more microcapsules are positioned in the region from the surface of the toner particle to 1 μm in depth can be appropriately adjusted by adjusting the type or the added amount of a cohesive agent and the type or the added amount of particles containing the binder resin, for example.

In the group of toner particles according to the present embodiment, the percentage of toner particles in which two or more microcapsules are exposed on the surface is preferably 10% by number or less, more preferably 8% by number or less, and further preferably 5% by number or less. The percentage may be 0% by number.

If the percentage of toner particles in which two or more microcapsules are exposed on the surface is equal to or smaller than the upper limit value (i.e., 10% by number), toner is less likely to be scattered, and fogging on a printed image is less likely to occur.

The percentage of toner particles in which two or more microcapsules are exposed on the surface is measured as follows.

Surfaces of 100 toner particles which are randomly selected are observed by using a SEM. The number of toner particles in which two or more microcapsules are exposed on the surface is counted based on the surface observation, so as to obtain the percentage (percentage by number).

In the producing method of a toner particle, the percentage of toner particles in which two or more microcapsules are exposed on the surface can be appropriately adjusted by adjusting the type or the added amount of the cohesive agent and the type or the added amount of particles containing the binder resin, for example.

Figure 1B:
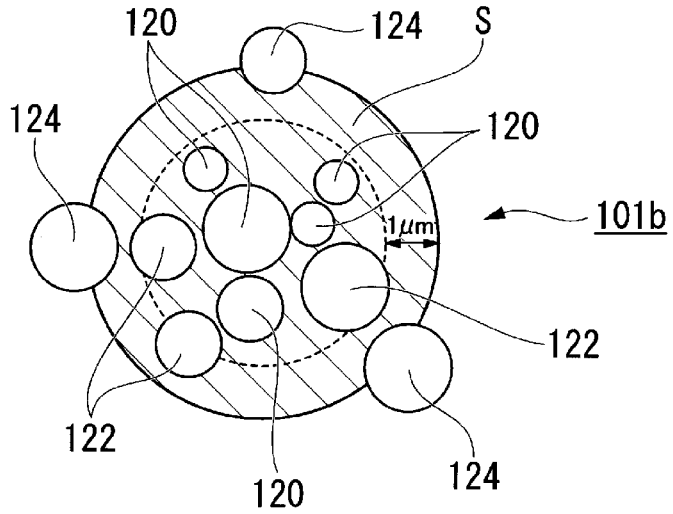
Figure 1C:
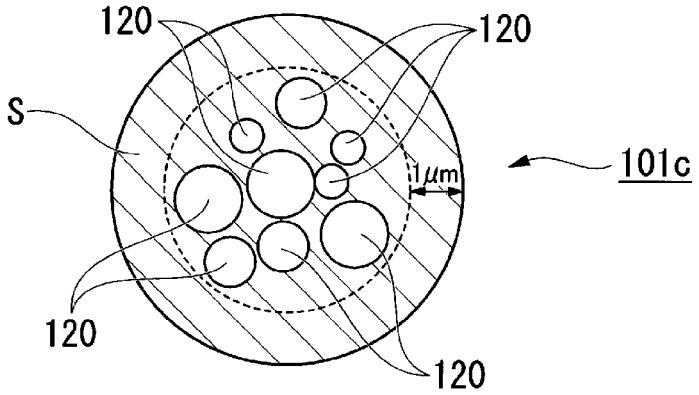

FIGS. 1A to 1C schematically illustrate a cross-section of a toner particle, which is obtained when the toner particle is observed by using the TEM and the image analysis is performed, as described above. FIGS. 1A and 1B schematically illustrate a cross-section of a toner particle in which one or more microcapsules are positioned in a region S from the surface to 1 μm in depth. FIG. 1C schematically illustrates a cross-section of a toner particle in which no microcapsule is positioned in the region S from the surface to 1 μm in depth.

Microcapsules 122 in a toner particle 101*a* shown in FIG. 1A correspond to the microcapsules positioned in the region S from the surface to 1 μm in depth. Microcapsules 122 and 124 in a toner particle 101*b* shown in FIG. 1B correspond to the microcapsules positioned in the region S from the surface to 1 μm in depth. The microcapsules 124 correspond to the microcapsules exposed on the surface. Microcapsules 120 shown in FIGS. 1A to 1C correspond to the microcapsules which are not positioned in the region S from the surface to 1 μm in depth.

The microcapsules will be described below in detail.

Each of the microcapsules in the present embodiment includes a fragrance ingredient enclosed by a wall film formed of a resin.

A volume average particle diameter of the group of microcapsules is preferably 0.10 μm to 10 μm, and more preferably 0.5 μm to 5 μm. If the volume average particle diameter of the microcapsules is equal to or greater than 0.10 μm, the microcapsule is more likely to be broken, and a scent is more likely to be effectively emitted as a result. If the volume average particle diameter of the microcapsules is equal to or smaller than 10 μm, a diameter of the toner particle is prevented from becoming too large, and good image quality can be obtained when the toner is mixed and used with coloring material.

The volume average particle diameter of the microcapsules is preferably 1% to 70%, and more preferably 10% to 50% with respect to the volume average particle diameter (generally, 3 μm to 20 μm, and preferably 3 μm to 15 μm) of toner particles.

As the fragrance ingredient, a fragrance ingredient liquid can be used. The liquid means that the fragrance ingredient is in a liquid state at a room temperature (25° C.).

The fragrance ingredient liquid is not particularly limited. For example, an oily fragrance ingredient which is generally used, a diluted solution thereof, and the like can be used. Examples of the oily fragrance ingredient include a natural or a synthetic fragrance ingredient of bromine styrene, phenyl ethyl alcohol, linalool, hexylcinnamic aldehyde, α-limonene, benzyl aldehyde, eugenol, bornyl aldehyde, citronellal, Coloral, terpineol, geraniol, menthol, cinnamic acid. One fragrance ingredient may be used or a combination of two or more types may be used.

Examples of the diluted solution of the fragrance ingredient include a diluted solution obtained by diluting the fragrance ingredient with an inodorous solvent of benzyl benzoates.

Examples of the resin for forming the wall film include a urea-formaldehyde resin, a melamine-formaldehyde resin, a guanamine-formaldehyde resin, a sulfonamide-aldehyde resin, an aniline-formaldehyde resin. From a viewpoint of excellent water resistance, chemical resistance, solvent resistance, and aging resistance, the melamine-formaldehyde resin is preferable as the resin.

Examples of the producing method of the microcapsule include an interfacial polymerization method, a coacervation method, an in-situ polymerization method, a solvent evaporation method, a submerged cure coating method. Among these methods, the in-situ method using a melamine resin as the wall film, and the interfacial polymerization method using a urethane resin as the wall film are preferable.

In the in-situ method, for example, the oily fragrance ingredient or a diluted solution thereof is emulsified in a water-soluble polymer solution or an aqueous surfactant solution. Then, a melamine-formalin prepolymer aqueous solution is added. Then, encapsulation of the fragrance ingredient is performed by performing heating and polymerizing, and microcapsules of the fragrance ingredient are obtained as a result. Polymerization may be continuously performed by adding the prepolymer aqueous solution little by little while maintaining pH of the solution to be acidic pH, if necessary.

In the interfacial polymerization method, for example, the oily fragrance ingredient or a diluted solution thereof, and polyvalent isocyanate prepolymer are dissolved and mixed. The mixture is emulsified in a water-soluble polymer solution or an aqueous surfactant solution. Then, a polybase of diamine, diol, and the like is added. Encapsulation of the fragrance ingredient is performed by performing heating and polymerizing, and microcapsules of the fragrance ingredient are obtained as a result.

The content percentage of the resin for forming the wall film in the microcapsule is preferably 0.1 parts by weight to 1 part by weight with respect to 1 part by weight of the fragrance ingredient, and is more preferably 0.2 parts by weight to 0.5 parts by weight.

The content percentage of the microcapsules is preferably 0.5 parts by weight to 30 parts by weight with respect to 100 parts by weight of toner particles, and is more preferably 1 part by weight to 15 parts by weight.

The binder resin will be described below in detail.

Examples of the binder resin according to the present embodiment include styrene-based resins such as polystyrene, styrene-butadiene copolymer, and styrene-acrylic copolymer; ethylene-based resins such as polyethylene, polyethylene-vinyl acetate copolymer, polyethylene-norbornene copolymer, and polyethylene-vinyl alcohol copolymer; polyester resins, acrylic resins, phenolic resins, epoxy resins, allyl phthalate resins, polyamide resins, and maleic acid resins.

The binder resin can be obtained by polymerizing a single type or plural types of a vinyl polymerizable monomer. Examples of vinyl polymerizable monomer include aromatic vinyl monomers of styrene, methyl styrene, methoxy styrene, phenyl styrene, chlorostyrene, and the like; ester-based monomers of methyl acrylate, ethyl acrylate, butyl acrylate, methyl methacrylate, ethyl methacrylate, butyl methacrylate, and the like; carboxylic acid-containing monomers of acrylic acid, methacrylic acid, fumaric acid, maleic acid, and the like; and amine-based monomers of amino acrylates, acrylamides, methacrylamides, vinyl pyridine, vinyl pyrrolidone, and the like.

The binder resin can be also obtained by polycondensing a polymerizable monomer in a polycondensation system, which is formed from an alcohol component and a carboxylic component. Examples of the alcohol component include aliphatic diols such as ethylene glycol, 1,3-propanediol, 1,4-butanediol, 1,5-pentanediol, 1,6-hexanediol, 1,7-heptane diol, 1,8-octanediol, 1,9-nonanediol diol, 1,10-decanediol, 1,4-butenediol, 1,2-propanediol, 1,3-butanediol, neopentyl glycol, and 2-butyl-2-ethyl-1,3-propanediol; aromatic diols such as alkylene oxide adducts of bisphenol A; and polyhydric alcohol being trivalent or more, such as glycerin and pentaerythritol, and derivatives thereof. Examples of the alkylene oxide adducts of bisphenol A include polyoxypropylene(2.2)-2,2-bis(4-hydroxyphenyl) propane, and polyoxyethylene(2.2)-2,2-bis(4-hydroxyphenyl)propane. The alcohol component may be singly used or be used in combination of two or more types.

Examples of the carboxylic component include aliphatic dicarboxylic acids such as oxalic acid, malonic acid, maleic acid, fumaric acid, citraconic acid, itaconic acid, glutaconic acid, succinic acid, adipic acid, sebacic acid, azelaic acid, n-dodecyl succinic acid, and n-dodecenylsuccinic acid; alicyclic dicarboxylic acids such as cyclohexane dicarboxylic acid; aromatic dicarboxylic acids such as phthalic acid, isophthalic acid, and terephthalic acid; and polycarboxylic acid being trivalent or more, such as trimellitic acid, pyrolimellit, and derivatives thereof. One type of the carboxylic component may be used or a combination of two or more types may be used.

When the polymerizable monomer is polymerized, any of well-known assist agents such as a chain transfer agent, a crosslinking agent, a polymerization initiator, a surfactant, a cohesive agent, a pH regulator, and a defoaming agent, which is used when the binder resin is polymerized may be used.

Examples of the chain transfer agent include carbon tetrabromide, dodecyl mercaptan, trichlorobromomethane, and dodecanethiol.

As the crosslinking agent, a compound having two unsaturated bonds or more, such as divinyl benzene, divinyl ether, divinyl naphthalene, and diethyleneglycol dimethacrylate may be used.

Examples of the polymerization initiator include a water-soluble initiator and an oil-soluble initiator. The type of the initiator is selected in accordance with a polymerization method. Examples of the water-soluble initiator include persulfate such as potassium persulfate and ammonium persulfate; azo compounds such as 2,2-azobis(2-aminopropane); hydrogen peroxide, and benzoyl peroxide. Examples of the oil-soluble initiator include azo compounds such as azobis isobutyronitrile, and azobis dimethylvaleronitrile; and peroxide such as benzoyl peroxide, and dichlorobenzoyl peroxide. If necessary, a redox initiator may be used.

Examples of the surfactants include anionic surfactants, cationic surfactants, amphoteric surfactants, and non-ionic surfactants. Examples of the anionic surfactants include aliphatic salts, alkyl sulfate ester salts, polyoxyethylene alkyl ether sulfuric ester salt, alkyl benzene sulfonates, alkyl naphthalene sulfonates, dialkyl sulfosuccinates, alkyl diphenyl ether disulfonates, polyoxyethylene alkyl ether phosphates, alkenylsuccinic salts, alkanesulfonates, naphthalenesulfonic acid formalin condensate salts, aromatic sulfonic acid formalin condensate salts, polycarboxylic acid, and polycarboxylate. Examples of the cationic surfactants include alkyl amine salts, and alkyl quaternary ammonium salts. Examples of the amphoteric surfactants include alkyl betaine and alkyl amine oxide. Examples of the non-ionic surfactants include polyoxyethylene alkyl ethers, polyoxyalkylene alkyl ethers, polyoxyethylene derivatives, sorbitan fatty acid esters, polyoxyethylene sorbitan fatty acid esters, polyoxyethylene sorbitol fatty acid esters, glycerin fatty acid esters, polyoxyethylene fatty acid esters, polyoxyethylene hydrogenated castor oil, polyoxyethylene alkylamine, and alkyl alkanolamide. Among these surfactants, one type or a combination of two or more types may be used.

Examples of the cohesive agent include a monovalent salt such as sodium chloride, potassium chloride, lithium chloride, and sodium sulfate; a bivalent salt such as magnesium chloride, calcium chloride, magnesium sulfate, calcium nitrate, zinc chloride, ferric chloride, and ferric sulfate; and a trivalent salt such as aluminum sulfate and aluminum chloride. As the cohesive agent, an organic coagulant or an organic polymer cohesive agent, such as polyhydroxypropyl dimethyl ammonium chloride, polydiallyldimethylammonium chloride, and quaternary ammonium salts may be used.

Examples of the pH regulator include acidic compounds such as hydrochloric acid, sulfuric acid, nitric acid, acetic acid, citric acid, and phosphoric acid; and alkalis such as sodium hydroxide, potassium hydroxide, ammonia, and amine compounds. Examples of the amine compounds include dimethylamine, trimethylamine, monoethylamine, diethylamine, triethylamine, propylamine, isopropylamine, dipropylamine, butylamine, isobutylamine, sec-butylamine, monoethanolamine, diethanolamine, triethanolamine, triisopropanolamine, isopropanolamine, dimethylethanolamine amine, diethylethanolamine, N-butyl diethanolamine, N,N-dimethyl-1,3-diaminopropane, N,N-diethyl-1,3-diaminopropane. As the pH regulator, an acidic or an alkali surfactant may be used.

Examples of the defoaming agent include a lower alcohol-based defoaming agent, an organic polar compound-based defoaming agent, a mineral-oil-based defoaming agent, and a silicone-based defoaming agent. Examples of the lower alcohol-based defoaming agent include methanol, ethanol, isopropanol, and butanol. Examples of the organic polar compound-based defoaming agent include 2-ethylhexanol, amyl alcohol, diisobutyl carbinol, tributyl phosphate, oleic acid, tall oil, metal soap, sorbitan lauric acid monoester, sorbitan oleic acid monoester, sorbitan oleic acid triester, low molecular polyethylene glycol oleate ester, a nonylphenol EO low molar adduct, a pluronic type EO low molar adduct, polypropylene glycol, and derivatives of the above substances. Examples of the mineral-oil-based defoaming agent include a mineral oil surfactant blend, and a surfactant blend of mineral oil and an aliphatic metal salt. Examples of the silicone-based defoaming agent include a silicone resin, a surfactant blend of a silicone resin, and an inorganic powder blend of a silicone resin.

One type of the binder resin or a combination of two or more types may be used.

As the binder resin, a polyester resin which has good fixability and has a small influence on a scent is preferable. A resin of which an acid value is equal to or greater than 1 mgKOH/g is preferable among polyester resins. If the acid value of the polyester resin is equal to or greater than the lower limit value (i.e., 1 mgKOH/g), dispersibility of particles is improved when the binder resin is used in a form of particles. Particularly, when an aggregate method (described below) is employed, a dispersion of particles having a small particle diameter can be obtained when an alkali pH regulator is added.

A glass transition temperature (Tg) of the binder resin is preferably 25° C. to 80° C., and more preferably 25° C. to 65° C. If the glass transition temperature is excessively high, microcapsules are not likely to be broken by rubbing a toner printed layer with a finger and a scent may not properly come out. Tg of the binder resin is measured by a DSC, for example.

A softening temperature of the binder resin is preferably 80° C. to 180° C., and more preferably 90° C. to 160° C. If the softening temperature of the binder resin is in the desired range, emission of the fragrance ingredient when a toner is produced or fixed is less likely to occur. As a result, a scent is more likely to be emitted by rubbing an image formed of the toner with a finger. The softening temperature of the binder resin is measured by a DSC, for example.

As the binder resin, in order not to have an influence on the scent of the fragrance ingredient, an inodorous resin or a resin having little odor is preferably used.

The toner particle according to the present embodiment may contain other additives in addition to the microcapsules and the binder resin.

As other additives, a release agent, a charge-controlling agent, an oxidant inhibitor, a colorant, and the like are exemplified.

The other additives will be described below in detail.

The release agent is added to the toner particles for improving low-temperature fixability of the toner, preventing contamination of the toner to a surface of a roller when thermal fixing is performed, and improving abrasion resistance of a printed matter.

Examples of the release agent include low-molecular weight polyethylene, low molecular weight polypropylene, polyolefin copolymers; an aliphatic hydrocarbon-based wax such as a polyolefin wax, a microcrystalline wax, a paraffin wax, and a Fischer Tropsch Wax; an oxide of aliphatic hydrocarbon-based wax such as an oxidized polyethylene wax, or block copolymer of these substances; a botanical wax such as a candelilla wax, a carnauba wax, a vegetable wax, a jojoba wax, and a rice wax; an animal wax such as a beeswax, a lanoline, and a spermaceti wax; a mineral wax such as ozokerite, ceresin, and petrolatum; waxes which contain fatty acid ester as a main component, such as a montanic acid ester wax, and a caster wax; a substance obtained by de-oxidizing a portion or the entirety of fatty acid ester, such as a de-oxidized carnauba wax; saturated straight chain fatty acid such as palmitic acid, stearic acid, montanic acid, and long chain alkylcarboxylic acids having long chain alkyl; unsaturated fatty acid such as brassidic acid, eleostearic acid, and barinarin acid; saturated alcohol such as stearyl alcohol, eicosyl alcohol, behenyl alcohol, carnaubyl Bill alcohol, glyceryl alcohol, melissyl alcohol, and long chain alkylalcohol having long chain alkyl; polyhydric alcohol such as sorbitol; fatty acid amide such as amide linoleate, amide oleate, lauric acid amide; saturated fatty acid bisamide such as methylene-bis-stearic acid amide, ethylene capric acid amide, ethylenebis lauric acid amide, and hexamethylene bis-stearic acid amide; unsaturated fatty acid amides such as ethylene-bis-oleic acid amide, hexamethylene bis-oleic acid amide, N, N'-dioleoyl adipic amide, N,N'-dioleylsebacic acid amide; aromatic bisamide such as m-xylene bis-stearic acid amide, and N,N'-distearyl isophthalic acid amide; a fatty acidic metal salt (substance generally referred to as metal soap) such as calcium stearate, calcium laurate, zinc stearate, and magnesium stearate; a wax obtained by grafting styrene or vinyl monomer of acrylic acid and the like into an aliphatic hydrocarbon wax; a partially esterified substance of fatty acid such as behenic acid monoglyceride, and polyhydric alcohol; and a methyl ester compound having a hydroxy group which is obtained by adding hydrogen to vegetable oil.

As the release agent, in order not to have an influence on the scent of the fragrance ingredient, an inodorous resin or a resin having little odor is preferably used. The release agent may be refined in order to reduce odor.

In a case where the toner particles according to the present embodiment contain the release agent, the content of the release agent is preferably 1 wt % to 20 wt % with respect to the total weight of the toner. If the content of the release agent is equal to or smaller than the upper limit value (i.e., 20 wt %), after printing, volatilization of the fragrance ingredient from the microcapsules in a printed image is less likely to occur.

Examples of the charge-controlling agent include a metal-containing azo compound, and a metal-containing salicylic acid derivative. Examples of the metal-containing azo compound include a complex or a complex salt obtained by using zirconium, zinc, chrome or boron as a metal element, or a mixture thereof. Examples of the metal-containing salicylic acid derivative include a complex or a complex salt obtained by using zirconium, zinc, chrome or boron as a metal element, or a mixture thereof.

As the toner according to the present embodiment, a form (colored aromatic toner) including a colorant and a form (non-colored aromatic toner) which does not include a colorant can be used. As the colorant mixed with the colored aromatic toner, a pigment and a dye can be used. To suppress blurring of an image or a printed matter due to oily fragrance ingredient emitted after microcapsules are broken, the pigment is more preferable as the colorant. As the pigment, any of an organic pigment and an inorganic pigment may be used.

Examples of the pigment include a black pigment, a yellow pigment, a magenta pigment, and a cyan pigment.

As the black pigment, carbon black can be used. Examples of the carbon black include acetylene black, furnace black, thermal black, channel black, and Ketjen black. One type of the black pigment or a combination of two or more types may be used.

Examples of the yellow pigment include C.I.Pigment Yellow 1, 2, 3, 4, 5, 6, 7, 10, 11, 12, 13, 14, 15, 16, 17, 23, 65, 73, 74, 81, 83, 93, 95, 97, 98, 109, 117, 120, 137, 138, 139, 147, 151, 154, 167, 173, 180, 181, 183, and 185, and C.I.Vat Yellow 1, 3, and 20. One type of the yellow pigment or a combination of two or more types may be used.

Examples of the magenta pigment include C.I.Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 146, 150, 163, 184, 185, 202, 206, 207, 209, and 238, C.I.Pigment Violet 19, and C.I.Vat Red 1, 2, 10, 13, 15, 23, 29, and 35. One type of the magenta pigment or a combination of two or more types may be used.

Examples of the cyan pigment include C.I.Pigment Blue 2, 3, 15, 16, 17, C.I.Vat Blue 6, and C.I.Acid Blue 45. One type of the cyan pigment or a combination of two or more types may be used.

The colorant of one color or a combination of two or more colorants of different colors may be used.

A producing method of the toner particles will be described below in detail.

The producing method of the toner particles according to the present embodiment includes an aggregation process of aggregating microcapsules and particles containing the binder resin.

For example, the aggregation process includes a first aggregation operation and a second aggregation operation. In the first aggregation operation, microcapsules and particles (A1) containing a binder resin are aggregated so as to obtain a primary aggregate. In the second aggregation operation, the primary aggregate and particles (A2) containing a binder resin are aggregated so as to obtain a secondary aggregate.

The first aggregation operation will be described below in detail.

In the first aggregation operation, microcapsules and particles (A1) containing a binder resin are aggregated so as to obtain the primary aggregate.

As an aggregation method of the microcapsules and the particles (A1), a method of using a dispersion of the microcapsules and a dispersion of the particles (A1) can be employed.

As the dispersion of the microcapsules, a dispersion produced by dispersing microcapsules in an aqueous medium using a known method can be used. As the aqueous medium, water is preferable.

As the dispersion of the particles (A1), a dispersion (P1) in which the particles (A1) are dispersed in an aqueous medium is used. As the aqueous medium, water is preferable.

A producing method of the dispersion (P1) will be described below in detail.

As the producing method of the dispersion (P1), the following method can be employed.

First, the binder resin, and, if necessary, other additives such as a release agent, a charge-controlling agent, an oxidant inhibitor, and a colorant are molten and kneaded, or are mixed, and a mixture thereof is obtained. The obtained mixture is pulverized by a pulverizer, and thereby coarse particles are obtained.

The pulverizer is not particularly limited. For example, a ball mill, an atomizer, a Bantam mill, a pulverizer, a Hammer mill, a roll crusher, a cutter mill, a jet mill, and the like are used.

The volume average particle diameter of the coarse particles is preferably 0.01 mm to 2 mm, and more preferably 0.02 mm to 1 mm. If the volume average particle diameter is smaller than 0.01 mm, strong stirring is required for dispersing the coarse particles in an aqueous medium, and foams generated by stirring tend to deteriorate dispersibility. If the volume average particle diameter is greater than 2 mm, the diameter of the particle is greater than the size of a gap provided in a shearing unit. For that reason, the shearing unit may be clogged with the particles or particles having an un-uniform composition, or an un-uniform particle diameter may be generated due to a difference between energies applied to the inside of the mixture and the outside thereof.

Then, the coarse particles are dispersed in an aqueous medium, and a coarse particle dispersion is obtained. In this process, a surfactant or an alkali pH regulator may be added to the aqueous medium.

Addition of the surfactant causes the surfactant to adhere to the surface of the coarse particles, and causes the coarse particles to be dispersed in the aqueous medium.

At this time, the concentration of the surfactant is preferably equal to or greater than a critical micelle concentration. Here, the critical micelle concentration means the minimum concentration of the surfactant required to form micelles in water. The critical micelle concentration is obtained by measuring surface tension or electrical conductivity. If the surfactant having a concentration which is equal to or greater than the critical micelle concentration is contained, the dispersibility is further improved.

A dissociation degree of a dissociative functional group on a surface of the binder resin may be increased and polarity of the dissociative functional group may be strengthened, by adding the alkali pH regulator. As a result, self-dispersibility of the binder resin is improved.

Then, if necessary, the coarse particle dispersion is defoamed. Since the binder resin and the release agent have low hydrophilicity, it is preferable that dispersing using the surfactant is performed in the aqueous medium. However, in this case, foams may be generated. If the coarse particle dispersion containing foams is atomized by a high pressure atomizer in the post-process, to the forms may prevent a plunger of a high pressure pump from working properly and an operation of the plunger may become unstable. Particularly, when a plurality of plungers is mounted in row in order to prevent a pulsating flow, an operation of the plurality of plungers is controlled. Thus, if the forms are contained, atomization may not be properly carried out. Further, because the high pressure atomizer includes a check valve, if foams are contained in a treatment liquid, particles are more likely to be attached to the check valve and the check valve is more likely to be clogged. If the check valve is clogged, the treatment liquid does not flow and thus atomization may not be properly carried out.

As a defoaming method, vacuum decompression defoaming, centrifugal defoaming, addition of a defoaming agent, and the like can be employed. Any method may be employed as long as the foams are removed. However, when the defoaming agent is added, a defoaming agent which does not influence the post-process is preferably selected. In addition, a defoaming agent which does not cause deterioration of charging characteristics due to remaining in the toner is preferably selected. As the defoaming method, decompression defoaming is preferable because of simplicity of the process. In the decompression defoaming, defoaming is preferably performed in such a manner that a treatment liquid is put into a pressure proof container which includes a stirring machine, and is decompressed to about −0.09 MPa by a vacuum pump while stirring.

After the dispersion of the coarse particles is prepared in this manner, if necessary, wet pulverization is performed. The particle diameter of the particles is reduced more by the wet pulverization, so that the particles can be more easily atomized in the subsequent process.

The coarse particle dispersion is heated to a temperature equal to or higher than the glass transition temperature Tg of the binder resin, for example.

Then, the coarse particles in the coarse particle dispersion are atomized by an atomizer, and thereby the particles (A1) containing the binder resin are obtained. The particles (A1) are mechanically dispersed in an aqueous medium by the atomizer, and thereby the dispersion (P1) is obtained.

Examples of the atomizer include a high pressure atomizer, a rotor-stator agitator, and a medium type agitator.

Examples of the high pressure atomizer include a nanomizer (manufactured by Yoshida Kikai Co., Ltd.), an ultimizer (manufactured by Sugino Machine, LTD.), NANO3000 (manufactured by Beryu System Corporation), Microfluidizer (manufactured by Mizuho Industrial CO., LTD.), and a homogenizer (manufactured by Izumi Food Machinery Co., Ltd.). Examples of the rotor-stator agitator include Ultra-Turrax (manufactured by IKA Corporation), T.K. Auto Homo Mixer (manufactured by Primix Corporation), T.K. Pipeline Homo Mixer (manufactured by Primix Corporation), T.K. Filmix (manufactured by Primix Corporation), Clearmix (manufactured by M Technique Co., Ltd.), Clear-SS5 (manufactured by M Technique Co., Ltd.), Cavitron (manufactured by Eurotec Co., Ltd.), Fine flow mill (manufactured by Pacific Machinery & Engineering Co., Ltd). Examples of the medium type agitator include Visco Mill (manufactured by Aimex CO., Ltd.), Apex Mill (manufactured by Kotobuki Kogyou. CO., LTD.), Star Mill (manufactured by Ashizawa Finetech Ltd.), DCP Super Flow (manufactured by Nippon Eirich Co., Ltd.), MP Mill (manufactured by Inoue MFG., Inc.), Spike Mill (manufactured by Inoue MFG., Inc.), Mighty Mill (manufactured by Inoue MFG., Inc.), SC Mill (manufactured by Nippon Coke & Engineering CO., LTD.).

In the high pressure atomizer, particles are caused to pass through a minute nozzle while pressure of, for example, 10 MPa to 300 MPa is applied. As a result, the particles undergo mechanical shearing, and the coarse particles are finely granulated. Then, particles may be cooled down to Tg of the binder resin or lower. This cooling causes the melted particles to be solidified. Since the treatment liquid is rapidly cooled, aggregation or integration by cooling is unlikely to occur.

In this manner, the dispersion (P1) of the particles (A1) which contain the binder resin is obtained. This method is preferable because the particles (A1) in which the release agent, the charge-controlling agent, and the like are uniformly dispersed in the binder resin are obtained.

Alternatively, the dispersion (P1) may be produced by using the following emulsion polymerization method.

According to the emulsion polymerization method, first, an oil phase component obtained by mixing a vinyl-based polymerizable monomer and, if necessary, a chain transfer agent is manufactured. The vinyl-based polymerizable monomer is used as a raw material of the binder resin. The oil phase component is emulsified and dispersed in a water phase component which is an aqueous surfactant solution, and a water-soluble polymerization initiator is added. The resultant of the addition is heated to cause polymerization. Other additives such as the release agent or the charge-controlling agent may be mixed with the oil phase component, in addition to the vinyl monomer. The dispersion (P1) of the particles (A1) which contain the binder resin may be produced through the emulsion polymerization. The volume average particle diameter of the particles (A1) is 0.01 μm to 1 μm. During the emulsion polymerization, polymerization may be performed while the oil phase component is dropped into the water phase component. In addition, the polymerization initiator may be added again during the polymerization, in order to adjust a molecular weight.

Further alternatively, the dispersion (P1) may be produced by using the following phase reversal emulsion method.

According to the phase reversal emulsion method, first, an oil phase component containing the binder resin is heated and melted. Then, an aqueous solution which contains a surfactant and a pH regulator is gradually added to the melted oil phase component. As the aqueous solution is added, phase reversal from W/O to O/W occurs. After phase reversal, cooling is performed, and thereby the dispersion (P1) of the particles (A1) containing the binder resin is obtained. The volume average particle diameter of the particles (A1) is 0.01 μm to 5 μm. Here, a surfactant, a pH regulator, a solvent, ion exchange water, and the like may be added to the oil phase component, in advance. When the solvent is added, viscosity of the oil phase component is reduced, and thus heating may be not required. However, in this case, the solvent needs to be removed after the phase reversal emulsion.

The volume average particle diameter of the particles (A1) in the dispersion (P1) is preferably 0.01 μm to 5.0 μm, and more preferably 0.05 μm to 2.0 μm. The volume average particle diameter of the particles (A1) in the dispersion (P1) is preferably 0.1% to 70% with respect to the volume average particle diameter of microcapsules, and more preferably 0.5% to 50%.

During the first aggregation operation, the dispersion (P1) is added to the dispersion of microcapsules.

At this time, by adding a cohesive agent, the particles (A1) are attached to each of one or more microcapsules and aggregated as the primary aggregate.

As the cohesive agent, a cohesive agent similar to the cohesive agent used in polymerization of the binder resin is used.

The added amount of the cohesive agent is appropriately adjusted in accordance with dispersibility of the particles (A1). The added amount of the cohesive agent is adjusted to be large when the particles (A1) have high dispersion stability, and to be small when the particles (A1) have low dispersion stability. The added amount thereof is also adjusted in accordance with the type of the cohesive agent. For example, when aluminium sulfate is used as the cohesive agent, the cohesive agent is added to be 0.1 wt % to 50 wt % with respect to the particles (A1), and preferably added to be 0.5 wt % to 10 wt %.

The size of the primary aggregate is adjusted in accordance with the type of the cohesive agent. For example, when a cohesive agent having strong cohesiveness, such as aluminium sulfate, is added, a primary aggregate having a volume average particle diameter of 0.1 μm to 10 μm is obtained. When a cohesive agent having weak cohesiveness, such as sodium chloride, is added, an aggregate may be not obtained.

When the cohesive agent is added, in order to prevent rapid aggregation of particles, the rotor-stator-type disperser is preferably used. Also, in order to prevent rapid aggregation, a pH regulator and a surfactant may be added to the dispersion before the cohesive agent is added. According to the above operations, the particle diameter of a toner finally obtained can be adjusted to be uniform.

When aggregation is started, that is, when the dispersion of the particles (A) is added to the dispersion of the microcapsules, if signs of zeta-potentials of the microcapsules and the particles (A1) are reverse to each other, hetero-aggregation of the particles (A1) to the surface of the microcapsule can be performed. As a result, the primary aggregate can be formed.

For example, regarding each of the microcapsules or the particles (A1), as a percentage of particles having a sign reverse to the sign of an average value of the zeta-potentials becomes small, the particles (A1) can be more stably and more uniformly subjected to hetero-aggregation around the microcapsules.

By adjusting the zeta-potential, it is possible to adjust a position of the microcapsule in a toner particle.

A surfactant or a pH regulator which has reverse polarity may be used in order to adjust the zeta-potential of the microcapsules or the particles (A1). For example, by adding a cationic surfactant, a negative value of the zeta-potential of the dispersed particles may be reduced, and further the sign of the zeta-potential may be reversed to positive. Similarly, by adding an anionic surfactant, a positive value of the zeta-potential of the dispersed particles may be reduced, and further the sign of the zeta-potential may be reversed to negative. When the dispersed particles have bipolarity, the positive or negative value of the zeta-potential may be adjusted by adjusting pH.

In the present embodiment, a cationic surfactant or a pH regulator is added to a dispersion of microcapsules having a negative zeta-potential, so that the zeta-potential of the microcapsules becomes be positive. Then, the dispersion of the particles (A1) having a negative zeta-potential is added, so that the particles (A1) may be stably aggregated around the microcapsules.

The primary aggregate formed in the above-described manner is heated to Tg of the binder resin or higher, that is, for example, in a temperature range of 40° C. to 95° C. Thus, fusion between aggregated particles may be accelerated and densified. If necessary, a stabilizer such as a pH regulator and a surfactant is added before the fusion, so that the primary aggregate may be stabilized.

The second aggregation operation will be described below in detail.

According to the second aggregation operation, the primary aggregate obtained through the first aggregation operation and particles (A2) containing a binder resin are aggregated into a secondary aggregate.

As an aggregation method of the primary aggregate and the particles (A2), a method of using a dispersion of the primary aggregate and a dispersion of the particles (A2) may be employed.

As the dispersion of the primary aggregate, a dispersion of the primary aggregate obtained through the first aggregation operation is used.

As the dispersion of the particles (A2) containing a binder resin, a dispersion (P2) in which the particles (A2) are dispersed in an aqueous medium is used.

The dispersion (P2) is produced in a manner similar to the one to produce the dispersion (P1). Materials similar to those for the dispersion (P1) or materials different from the dispersion (P1) may be used for the dispersion (P2). Because of excellent productivity, materials similar to those for the dispersion (P1) are preferably used for the dispersion (P2).

During the second aggregation operation, the dispersion (P2) is added to the dispersion of the primary aggregate. As a result, the particles (A2) are attached around the primary aggregate, and aggregated as a secondary aggregate. That is, through the second aggregation operation, a secondary aggregate in which the primary aggregate as a core is surrounded by the particles (A2) as a shell is obtained.

The added amount of the particles (A2) is preferably 25 wt % to 65 wt % with respect to the entire toner particles. If the added amount of the particles (A2) is equal to or smaller than the upper limit value (i.e., 65 wt %), one or more microcapsules are more likely to be positioned in a region from the surface of a toner particle to 1 μm in depth. Thus, a toner particle in which emission of fragrance is maintained for a long period of time can be obtained.

If the added amount of the particles (A2) is equal to or greater than the lower limit value (i.e., 25 wt %), exposure of the microcapsules on the surface of a toner particle can be suppressed. Thus, it is possible to suppress the microcapsules from being broken during an image forming process, and thus volatilization of the fragrance ingredient. In addition, contamination of each member of an image forming apparatus by the fragrance ingredient can be suppressed. It is possible to ensure charging stability of a toner particle, and to obtain a good image without fogging and the like.

In the second aggregation operation, a cohesive agent may be used. As the cohesive agent, a cohesive agent similar to the cohesive agent used in the first aggregation operation can be used.

The secondary aggregate formed in the above-described manner is preferably heated to Tg of the binder resin or higher, that is, for example, in a temperature range of 40° C. to 95° C., so that fusion is accelerated and densified. If necessary, a stabilizer such as a pH regulator and a surfactant is added before the fusion, so that the secondary aggregate may be stabilized.

The secondary aggregate obtained through the aggregation process is washed, subjected to solid-liquid separation, and dried. As a result, a toner particle having a volume average particle diameter of 3 μm to 20 μm, preferably 3 μm to 15 μm, is obtained.

Examples of a washing device used in the washing include a centrifugal separation device and a filter press. Examples of a washing liquid used in the washing include water, ion exchange water, purified water, water adjusted to be acidic, and water adjusted to be basic.

Examples of a dryer used in the drying include a vacuum dryer, an airflow dryer, and a fluid dryer.

If necessary, an external additive may be added to the toner particle obtained in the above-described manner. Fluidity and charging properties of the toner particle can be adjusted by adding the external additive. Also, it is possible to prevent the microcapsules from being broken during the image forming process.

As the inorganic fine particle, inorganic fine particles may be used. Examples of the inorganic fine particles include particles of silica, titania, alumina, strontium titanate, and tin oxide, of which the volume average particle diameter is 5 nm to 1000 nm. One type of the inorganic fine particle or a combination of two or more types may be used. Because of excellent environmental stability, inorganic fine particles subjected to surface treatment with a hydrophobizing agent may be used. As the external additive, fine resin particles of which the volume average particle diameter is equal to or smaller than 1 μm may be added in addition to the inorganic fine particles. Cleaning properties are improved by adding the fine resin particles. The added amount of the external additive is preferably 0.01 wt % to 20 wt % with respect to the entirety of a toner.

The external additive is added by being mixing with the toner particles using a mixer. Examples of the mixer include a Henschel mixer (manufactured by Nippon coke & engineering Co., Ltd.), Super Mixer (manufactured by Kawata MFG Co., Ltd.), Ribocone (manufactured by Okawara MFG Co., Ltd.), Nauta Mixer (manufactured by Hosogawa Micron Corporation), a Turbulizer (manufactured by Hosogawa Micron Corporation), and Cyclomix (manufactured by Hosogawa Micron Corporation), Spiral Pin Mixer (manufactured by Pacific Machinery & Engineering Co., Ltd), and Loedige Mixer (manufactured by Matsubo Corporation).

The toner according to the embodiment is classified into a toner (non-colored aromatic toner) to which no colorant is added, and a toner (colored aromatic toner) to which a colorant is added.

The non-colored aromatic toner can be printed, as a plane or a plurality of dots, at a certain location (for example, the entire surface of an image, a portion thereof, or a non-image portion out of a frame) of a sheet on which an image is formed by an electrophotographic method or other methods. When the portion of the sheet printed with the non-colored aromatic toner is pressed or rubbed with a finger, microcapsules of the toner are broken. As a result, fragrance is emitted from the broken microcapsules, which may cause an aromatic effect on the sheet (image).

The colored aromatic toner is can be used in image formation using an electrophotographic method. Thus, it is possible to form an image which can emit fragrance itself, and to contribute to cause an aromatic effect on the printed image.

A toner cartridge according to an embodiment will be described.

The toner cartridge according to an embodiment includes the above-described toner in a container. As the container, a well-known container may be used. The toner cartridge according to the present embodiment can be used in an image forming apparatus, and by using such an image forming apparatus an image (toner layer) that emits fragrance is obtained.

An image forming apparatus according to an embodiment will be described with reference to FIG. 2.

The image forming apparatus according to the present embodiment has a main body in which the above-described toner according is stored. For the image forming apparatus, a general electrophotographic device may be used.

Figure 2:
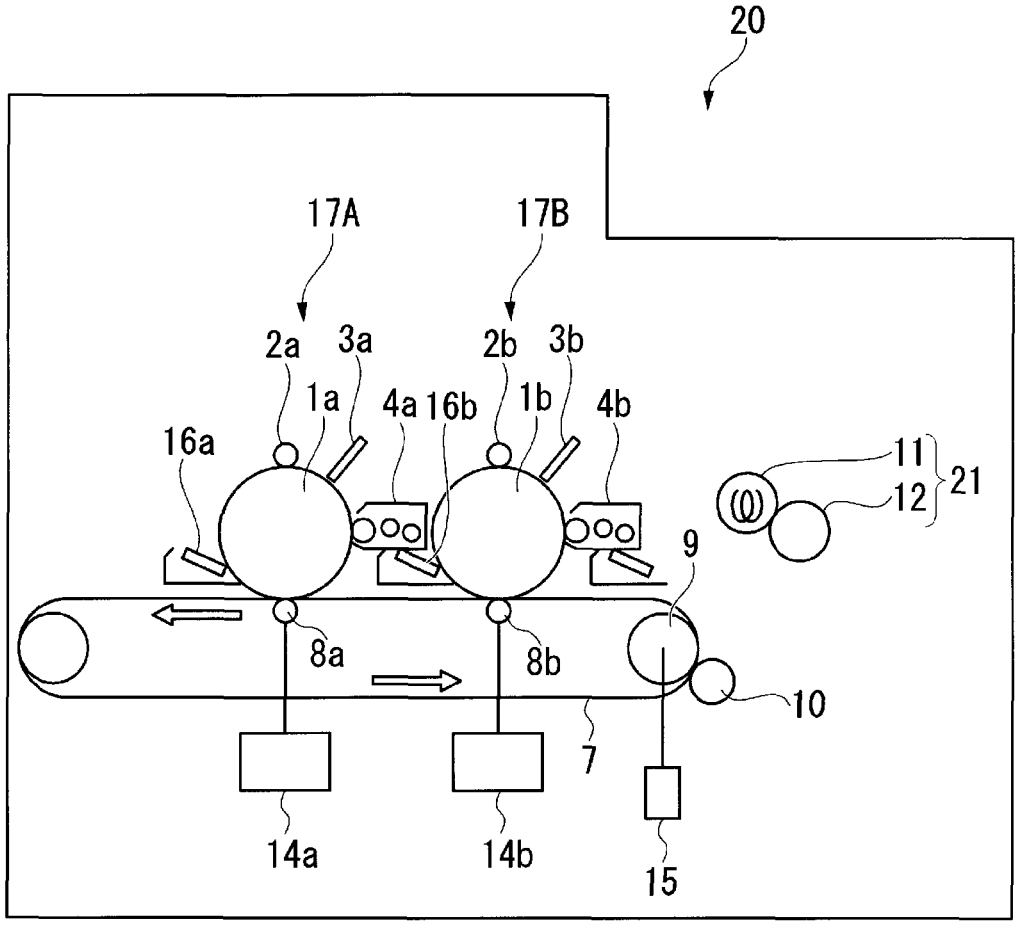
FIG. 2 is aside view of an image forming apparatus according to an embodiment.

FIG. 2 illustrates a schematic structure of the image forming apparatus according to the present embodiment.

A image forming apparatus 20 has the main body which includes an intermediate transfer belt 7, a first image forming unit 17A, a second image forming unit 17B, and a fixing device 21. The first image forming unit 17A and the second image forming unit 17B are provided over the intermediate transfer belt 7 in this order in a moving direction of the intermediate transfer belt 7. The fixing device 21 is provided on a downstream side of the intermediate transfer belt 7 in the moving direction. The first image forming unit 17A is provided on a downstream side of the second image forming unit 17B in the moving direction of the intermediate transfer belt 7. The fixing device 21 is provided on a downstream side of the first image forming unit 17A in the moving direction.

The first image forming unit 17A includes a photoconductive drum 1*a*, a cleaning device 16*a*, a charging device 2*a*, an exposure device 3*a*, a first developing device 4*a*, and a primary transfer roller 8*a*. The cleaning device 16*a*, the charging device 2*a*, the exposure device 3*a*, and the first developing device 4*a* are provided over the photoconductive drum 1*a* in this order in a moving direction of the photoconductive drum 1*a*. The primary transfer roller 8*a* is provided so as to face the photoconductive drum 1*a* with the intermediate transfer belt 7 between the primary transfer roller 8*a* and the photoconductive drum 1*a*. A toner (non-fragrance colored toner) containing a colorant, but not the microcapsules is stored in the first developing device 4*a*.

The non-fragrance colored toner may be a toner which contains the binder resin, the colorant, the wax, and the like. The non-fragrance colored toner may be produced by using various methods such as a pulverization method, a polymerization method, and an aggregation method. As the colorant, a pigment-based colorant is preferably used.

The second image forming unit 17B includes a photoconductive drum 1*b*, a cleaning device 16*b*, a charging device 2*b*, an exposure device 3*b*, a second developing device 4*b*, and a primary transfer roller 8*b*. The cleaning device 16*b*, the charging device 2*b*, the exposure device 3*b*, and the second developing device 4*b* are provided over the photoconductive drum 1*b* in this order in a moving direction of the photoconductive drum 1*b*. The primary transfer roller 8*b* is provided so as to face the photoconductive drum 1*b* with the intermediate transfer belt 7 between the primary transfer roller 8*b* and the photoconductive drum 1*b*. A toner (non-colored aromatic toner) containing no colorant, but containing the microcapsules is stored in the second developing device 4*b*.

A secondary transfer roller 9 and a backup roller 10 are disposed on a downstream of the second image forming unit 17B so as to face each other with the intermediate transfer belt 7 therebetween. The non-fragrance colored toner in the first developing device 4*a* and the non-colored aromatic toner in the second developing device 4*b* may be replenished from toner cartridges (not illustrated).

A primary transfer power source 14*a* is connected to the primary transfer roller 8*a*. A primary transfer power source 14*b* is connected to the primary transfer roller 8*b*.

A secondary transfer roller 9 and a backup roller 10 are disposed on a downstream of the first image forming unit 17A in the moving direction of the intermediate transfer belt 7 so as to face each other across the intermediate transfer belt 7. A secondary transfer power source 15 is connected to the secondary transfer roller 9.

The fixing device 21 includes a heat roller 11 and a pressing roller 12 which are disposed so as to face each other.

An image may be formed in a manner as follows, for example, by using the image forming apparatus 20.

First, the charging device 2*b* charges the photoconductive drum 1*b* uniformly. Then, the exposure device 3*b* performs exposing and thereby an electrostatic latent image is formed. Then, developing is performed with the non-colored aromatic toner supplied from the developing device 4*b*, and thereby a second toner image is obtained.

The charging device 2*a* charges the photoconductive drum 1*a* uniformly. Then, the exposure device 3*a* performs exposing based on first image information (second toner image) and thereby an electrostatic latent image is formed. Then, developing is performed with the non-fragrance colored toner supplied from the developing device 4*a*, and thereby a first toner image is obtained.

The second toner image and the first toner image are transferred on the intermediate transfer belt 7 in this order. The second toner image is transferred by the primary transfer roller 8*b*, and the first toner image is transferred by the primary transfer roller 8*a*.

An image obtained by stacking the second toner image and the first toner image onto the intermediate transfer belt 7 in this order is secondarily transferred onto a recording medium (not illustrated) between the secondary transfer roller 9 and the backup roller 10. Thus, the image obtained by stacking the second toner image and the first toner image in this order is formed on the recording medium.

That is, the second toner image which is formed of the non-colored aromatic toner including microcapsules is positioned at the top of the recording medium. Since the non-colored aromatic toner does not contain the colorant, the second toner image is transparent and the first toner image in a lower layer is not concealed.

If the image fixed on the recording medium is rubbed with the tip of a finger of a user, microcapsules contained in the toner in the top layer are broken, and the fragrance ingredient is emitted. In the above-described image forming apparatus 20, the colored toner image which is in the lower layer is over-coated with the non-colored aromatic toner stored in the second developing device 4*b*. Alternatively, as another embodiment, the non-colored aromatic toner may be stored in the first developing device 4*a*, and the non-fragrance colored toner may be stored in the second developing device. In this case, as the aromatic transparent toner is positioned in the lower layer, fragrance may be weaker when rubbed with a finger.

In the above-described embodiment, the colored toner is only a toner included in the developing device 4*a*, and the color of the toner can be selected arbitrarily. A plurality of developing devices that stores toners of different colors may be provided. For example, three developing devices for yellow, magenta, and cyan or four developing devices for the three colors and black may be provided. In this case, the aromatic toner can be formed on or below a full-color image, and thus the use of the aromatic toner is widened.

As a still another embodiment, toners (colored aromatic toner) which contains both the colorant and the microcapsules may be stored in each of the first developing device 4*a* and the second developing device 4*b*. The toners included in the first developing device 4*a* and the second developing device 4*b* may respectively contain colorants of different colors. In this case, microcapsules containing fragrance ingredient are contained in all of the toners. In this case, the type of the fragrance ingredients contained in the microcapsules of the toners may be the same or different. In this case, three toners for yellow, magenta, and cyan or four toners for the three colors and black may be prepared as the toners.

EXAMPLES

The embodiment will be more specifically described using examples. In the following descriptions, physical property values described in this specification were measured by using the following methods.

Volume Average Particle Diameter

Volume average particle diameters were obtained as a 50% volume average particle diameter (volume basis median diameter, that is, particle diameter obtained by accumulating particle diameters from a smaller particle diameter (may be from a larger particle diameter) to 50 volume % in volume basis particle diameter distribution). As a volume basis particle diameter distribution measuring device, the following devices were used depending on a measured target.

The volume average particle diameter of a toner and toner particles was measured by using "Multisizer 3" (manufactured by Beckman-Coulter, Inc., aperture diameter: 100 μm, measurable particle diameter range: 2.0 μm to 60 μm).

The particle diameter of the particles containing the microcapsule and the binder resin was measured by using a laser diffraction particle diameter measuring device ("SALD7000", product manufactured by Shimadzu Corporation; measurable particle diameter range: 0.01 μm to 500 μm).

Zeta-Potential

Zeta-potential of particles which contains the microcapsules and the binder resin in the dispersion was measured by using a zeta-potential measuring device ("ZEECOM ZC-300", product manufactured by Microtec Co., Ltd.). A sample is adjusted so as to cause solid concentration to be 50 ppm, and 100 particles were measured by manual measurement.

Manufacturing of Dispersion (q) of Microcapsules

An ethylene-maleic anhydride copolymer (product manufactured by Monsanto Chemicals Corporation, EMA-31) was heated and subjected to hydrolysis, and pH of a 5% aqueous solution was adjusted to 4.5. 100 mL of oily fragrance ingredient ("ORANGE-CS OIL IT", manufactured by Ogawa flavors & fragrance Corporation) which was used as an included matter was emulsified and dispersed in 100 g of the aqueous solution. The oily fragrance ingredient was dropped in a form of an oil droplet of 2 μm to 3 μm by using a homogenizer. Pure water was added to a methylol•melamine resin aqueous solution ("Sumirez resin 613", product manufactured by Sumitomo Chemical Co., Ltd.; resin concentration: 80%) so as to adjust resin concentration to 17%, and thereby an aqueous solution was obtained. While the emulsified dispersion was stirred, 50 g of the obtained aqueous solution was added, and stirring was continuously performed for 2 hours with maintaining the temperature of a system at 55° C. Thus, a methylol•melamine resin polymerization phase which was precipitated in the system was attracted to a surface of the oil droplet of the oily fragrance ingredient, and thereby a primary coated film of a microcapsule was formed. Then, the temperature of a system in which microcapsules having an attached primary coated film are suspended was cooled to the room temperature, and thereby a microcapsule slurry was obtained. While being stirring, pH of the microcapsule slurry was lowered to 3.5, and 80 g of an aqueous solution in which the aqueous solution of the methylol•melamine resin had a resin concentration adjusted to 25% were added. The temperature of the system was heated to 50° C. to 60° C.

After heating, stirring was continuously performed for about one hour. A concentrated polymerization liquid containing needle-like fine pieces of the methylol•melamine resin, which were precipitated in the system was attracted to a surface of the primary coated film of the microcapsule. As a result, a secondary coated film was formed. The temperature of the system was brought back to the room temperature, and 400 g of water were added. The secondary coated film was stably cured by the addition of the water. As a result, a dispersion (q) of microcapsules was obtained. The volume average particle diameter of the microcapsules in the dispersion (q) was 2 μm.

Manufacturing of Dispersion of Particles Containing Binder Resin 94 parts by weight of a polyester resin (glass transition temperature: 45° C., softening temperature: 100° C.) as the binder resin, 5 parts by weight of a rice wax as the release agent, and 1 part by weight of TN-105 (manufactured by Hodogaya Chemical Co., Ltd.) as the charge-controlling agent were uniformly mixed in a dry type mixer, and then were molten and kneaded at 80° C. in PCM-45 (manufactured by Ikegai Corporation) which is a biaxial kneader, and thereby obtaining a mixture. The obtained mixture was pulverized by a pin mill with 2 mm mesh pass, and was further pulverized by a bantam mill so as to have an average particle diameter of 50 μm. As a result, a pulverized matter was obtained. Then, 0.9 parts by weight of sodium dodecylbenzenesulfonate as the surfactant, 0.45 parts by weight of dimethyl amino ethanol as the pH regulator, and 68.65 parts by weight of ion exchange water were mixed, and thereby an aqueous solution was obtained. 30 parts by weight of the pulverized matter were dispersed in the obtained aqueous solution, and vacuum defoaming was performed, and thereby a dispersion was obtained. Then, the dispersion was atomized at 180° C. at 150 MPa by using a high pressure atomizer ("NANO3000", product manufactured by Beryu System Corporation). Maintaining at 180° C., decompression was performed, and then cooling was performed to 30° C., and thereby a dispersion of particles containing the binder resin was obtained. The volume average particle diameter of the particles in the obtained dispersion was 0.5 μm. The high pressure atomizer includes a high pressure pipe for heat exchange as a heating unit, a high pressure pipe as a pressing unit, a middle pressure pipe as a decompression unit, and a heat exchange pipe as a cooling unit. The high pressure pipe for heat exchange is 12 m and is immersed in an oil bath. The high pressure pipe as a pressing unit included nozzles of 0.13 μm and 0.28 μm which are mounted in row. The middle pressure pipe includes cells which have a hole diameter of 0.4 μm, 1.0 μm, 0.75 μm, 1.5 μm, and 1.0 μm and are mounted in row. The heat exchange pipe is 12 m and enabled to be cooled with tap water.

The dispersion of the particles containing the binder resin was divided into two dispersions. One of the divided dispersions was set as a dispersion (p1), and another was set as a dispersion (p2).

Toners in Examples 1 to 3, and Comparative Example 1 were produced as follows.

Example 1

While 1.5 parts by weight of the dispersion (q) of the microcapsules were stirred at 6500 rpm in a homogenizer (manufactured by IKA Corporation), 2.5 parts by weight of a 0.5% polydiallyldimethyl ammonium chloride solution were added. As a result, an average value of zeta-potential was changed from −68 mV to +35 mV. At this time, a percentage of particles having negative zeta-potential which was reverse to the average value in distribution of zeta-potential was 3% by number. Then, after 5 parts by weight of a 30% ammonium sulfate solution were added, a solution obtained by mixing 14 parts by weight of the dispersion (p1) and 80 parts by weight of ion exchange water was added (first aggregation operation) while being stirred at 800 rpm in a 1 L stirring tank in which a paddle blade is disposed. The resultant of the addition was heated to 40° C., while being stirred at 800 rpm in a 1 L stirring tank in which a paddle blade is disposed. After being held at 40° C. for one hour, a solution obtained by mixing 5 parts by weight of the dispersion (p2) and 10 parts by weight of ion exchange water was gradually added for five hours (second aggregation operation). Then, 10 parts by weight of a 10% poly-carboxylic acid sodium salt solution were added, heated to 68° C., and left for one hour. After being left, the solution was cooled, and thereby a toner particle dispersion was obtained.

The obtained toner particle dispersion was repeatedly filtered and washed with ion exchange water. The washing was performed until conductivity of a filtrate became 50 μS/cm, and the drying was performed in a vacuum dryer until a moisture content became equal to or smaller than 1.0 wt %. As a result, toner particles having a volume average particle diameter of 8.0 μm were obtained. Then, 2 parts by weight of hydrophobic silica and 0.5 parts by weight of titanium oxide as additives were attached to surfaces of 100 parts by weight of toner particles, and thereby the toner of Example 1 was obtained. The percentage of the particles containing the binder resin which was added in the second aggregation operation was 25 wt %.

Example 2

While 1.5 parts by weight of the dispersion (q) of the microcapsules were stirred at 6500 rpm in a homogenizer (manufactured by IKA Corporation), 2.5 parts by weight of a 0.5% polydiallyldimethyl ammonium chloride solution were added. As a result, an average value of zeta-potential was changed from −68 mV to +35 mV. At this time, a percentage of particles having negative zeta-potential which was reverse to the average value in distribution of zeta-potential was 3% by number. Then, after 5 parts by weight of a 30% ammonium sulfate solution were added, a solution obtained by mixing 6 parts by weight of the dispersion (p1) and 30 parts by weight of ion exchange water was added (first aggregation operation) while being stirred at 800 rpm in a 1 L stirring tank in which a paddle blade is disposed. The resultant of the addition was heated to 40° C., while being stirred at 800 rpm in a 1 L stirring tank in which a paddle blade is disposed. After being held at 40° C. for one hour, a solution obtained by mixing 13 parts by weight of the dispersion (p2) and 60 parts by weight of ion exchange water was gradually added for ten hours (second aggregation operation). Then, 10 parts by weight of a 10% poly-carboxylic acid sodium salt solution were added, heated to 68° C., and left for one hour. After being left, the solution was cooled, and thereby a toner particle dispersion was obtained.

The obtained toner particle dispersion was repeatedly filtered and washed with ion exchange water. The washing was performed until conductivity of a filtrate became 50 μS/cm, and the drying was performed in a vacuum dryer until a moisture content became equal to or smaller than 1.0 wt %. As a result, toner particles having a volume average particle diameter of 8.0 μm were obtained. Then, 2 parts by weight of hydrophobic silica and 0.5 parts by weight of titanium oxide as additives were attached to surfaces of 100 parts by weight of toner particles, and thereby the toner of Example 2 was obtained. The percentage of the particles containing the binder resin which was added in the second aggregation operation was 65 wt %.

Example 3

While 1.5 parts by weight of the dispersion (q) of the microcapsules were stirred at 6500 rpm in a homogenizer (manufactured by IKA Corporation), 2.5 parts by weight of a 0.5% polydiallyldimethyl ammonium chloride solution were added. As a result, an average value of zeta-potential was changed from −68 mV to +35 mV. At this time, a percentage of particles having negative zeta-potential which is reverse to the average value in distribution of zeta-potential was 3% by number. Then, after 5 parts by weight of a 30% ammonium sulfate solution were added, a solution obtained by mixing 15 parts by weight of the dispersion (p1) and 80 parts by weight of ion exchange water was added (first aggregation operation) while being stirred at 800 rpm in a 1 L stirring tank in which a paddle blade is disposed. The resultant of the addition was heated to 40° C., while being stirred at 800 rpm in a 1 L stirring tank in which a paddle blade is disposed. After being held at 40° C. for one hour, a solution obtained by mixing 4 parts by weight of the dispersion (p2) and 10 parts by weight of ion exchange water was gradually added for five hours (second aggregation operation). Then, 10 parts by weight of a 10% poly-carboxylic acid sodium salt solution were added, heated to 68° C., and left for one hour. After being left, the solution was cooled, and thereby a toner particle dispersion was obtained.

The obtained toner particle dispersion was repeatedly filtered and washed with ion exchange water. The washing was performed until conductivity of a filtrate became 50 μS/cm, and the drying was performed in a vacuum dryer until a moisture content became equal to or smaller than 1.0 wt %. As a result, toner particles having a volume average particle diameter of 8.0 μm were obtained. Then, 2 parts by weight of hydrophobic silica and 0.5 parts by weight of titanium oxide as additives were attached to surfaces of 100 parts by weight of toner particles, and thereby the toner of Example 3 was obtained. The percentage of the particles containing the binder resin which was added in the second aggregation operation was 20 wt %.

Comparative Example 1

While 1.5 parts by weight of the dispersion (q) of the microcapsules were stirred at 6500 rpm in a homogenizer (manufactured by IKA Corporation), 2.5 parts by weight of a 0.5% polydiallyldimethyl ammonium chloride solution were added. As a result, an average value of zeta-potential was changed from −68 mV to +35 mV. At this time, a percentage of particles having negative zeta-potential which is reverse to the average value in distribution of zeta-potential was 3% by number. Then, after 5 parts by weight of a 30% ammonium sulfate solution were added, a solution obtained by mixing 5 parts by weight of the dispersion (p1) and 30 parts by weight of ion exchange water was added (first aggregation operation) while being stirred at 800 rpm in a 1 L stirring tank in which a paddle blade is disposed. The resultant of the addition was heated to 40° C., while being stirred at 800 rpm in a 1 L stirring tank in which a paddle blade is disposed. After being held at 40° C. for one hour, a solution obtained by mixing 14 parts by weight of the dispersion (p2) and 60 parts by weight of ion exchange water was gradually added for ten hours (second aggregation operation). Then, 10 parts by weight of a 10% poly-carboxylic acid sodium salt solution were added, heated to 68° C., and left for one hour. After being left, the solution was cooled, and thereby a toner particle dispersion was obtained.

The obtained toner particle dispersion was repeatedly filtered and washed with ion exchange water. The washing was performed until conductivity of a filtrate became 50 μS/cm, and the drying was performed in a vacuum dryer until a moisture content became equal to or smaller than 1.0 wt %. As a result, toner particles having a volume average particle diameter of 8.0 μm were obtained. Then, 2 parts by weight of hydrophobic silica and 0.5 parts by weight of titanium oxide as additives were attached to surfaces of 100 parts by weight of toner particles, and thereby the toner of Comparative Example 1 was obtained. The percentage of the particles containing the binder resin which was added in the second aggregation operation was 70 wt %.

With respect to each of the toners according to the above-described examples, the percentage by number of toner particles containing one or more microcapsules positioned in a region from the surface of the toner particle to 1 μm in depth was obtained. Results are shown in Table 1.

Further, with respect to each of the toners according to the above-described examples, intensity of fragrance, printed matter (presence or absence of the fogging), and exposure of microcapsules on the surface were evaluated as follows. Evaluation results are shown in Table 1.

Evaluation of Intensity of Fragrance from Printed Matter

Each of the toners in the examples was mixed with ferrite carriers which were coated with a silicone resin, so that a developer has a toner ratio density of 8%.

The developer in each of the examples was stored in a developing device of an image forming unit in an electrophotographic complex ("e-studio 2050c", product manufactured by Toshiba Tec Corporation). The electrophotographic complex is a device including four image forming units. The developer containing each of the toners according to the examples was stored in the developing device of one unit among the four image forming units, and the non-fragrance colored toner was stored in developing devices of the remaining units.

The fixation temperature was set to 150° C., and a printed matter was obtained by printing a solid image on paper. The obtained printed matter was left for one week under conditions of a normal temperature and normal humidity (23° C., 60% RH). The left printed matter was rubbed with a finger five times at about a speed of 15 cm/s in an area of about 3 cm in width and 10 cm in length, in one direction. The rubbing was performed with finger pressure of about 50 g/cm$^2$. Intensity of the scent perceived at that time was evaluated based on the following criteria. Evaluation was performed based on the following criteria by using an average of 10 people.

A: Fragrance can be clearly recognized when paper is separated from the nose by about 30 cm.

B: Fragrance can be recognized to a certain degree when paper is separated from the nose by about 30 cm, and if the paper is moved closer to the nose, the fragrance can be recognized more clearly.

C: If paper is separated from the nose by about 30 cm, fragrance can be recognized faintly, and if the paper is moved closer to the nose, the fragrance can be recognized more clearly.

D: Recognition of fragrance is not possible when paper is separated from the nose by about 30 cm, but if the paper is moved closer to the nose, the fragrance can be recognized more clearly.

E: If paper is moved closer to the nose, fragrance can be recognized faintly, or recognition of any fragrance is not possible.

Evaluation of Printed Matter

An image of the printed matter (before being left) obtained for the evaluation of the intensity of fragrance was visually observed, and evaluated based on the following criteria.

A: Fogging is not observed in the image.

B: Fogging is observed at a portion of the image.

Evaluation of Surface Exposure

The toner particles were observed by using a SEM, and the percentage of toner particles in which two or more microcapsules were exposed on the surface was obtained. The obtained percentage was evaluated based on the following criteria.

A: The percentage of toner particles in which two or more microcapsules were exposed on the surface is equal to or smaller than 10% by number.

B: The percentage of toner particles in which two or more microcapsules were exposed on the surface is greater than 10% by number.

TABLE 1

| | Percentage of toner particles in which microcapsule is positioned in region of 1 μm from surface [% by number] | Evaluation of intensity of fragrance | Evaluation of printed matter | Evaluation of surface exposure |
|---|---|---|---|---|
| Example 1 | 84 | A | A | A |
| Example 2 | 62 | B | A | A |
| Example 3 | 86 | B | B | B |
| Comparative Example 1 | 43 | C | A | A |

Toners (Examples 1 to 3) containing toner particles in which one or more microcapsules are positioned in the region from the surface to 1 μm in depth in an amount of 60% by number or more maintained emission of fragrance for a long period of time.

Toners according to Examples 1 to 2 in which exposure of microcapsules on the surface is less could forma good image without fogging.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A toner, comprising:

a plurality of toner particles containing a binder resin and one or more microcapsules that contain a fragrant material, wherein a ratio of a number of toner particles that contain at least one microcapsule in a region from a surface thereof to 1 μm in depth with respect to a total number of the toner particles is equal to or greater than 60%.

2. The toner according to claim 1, wherein the ratio is equal to or greater than 70%.

3. The toner according to claim 1, wherein the ratio is equal to or greater than 80%.

4. The toner according to claim 1, wherein a second ratio of a number of toner particles that contain two or more microcapsules exposed on a surface thereof with respect to the total number of the toner particles is equal to or smaller than 10%.

5. The toner according to claim 4, wherein the second ratio is equal to or smaller than 8%.

6. The toner according to claim 4, wherein the second ratio is equal to or smaller than 5%.

7. The toner according to claim 1, wherein an average particle diameter of the microcapsules contained in the plurality of toner particles is equal to or greater than 0.1 μm and equal to or smaller than 10 μm.

8. The toner according to claim 1, wherein a ratio of an average particle diameter of the microcapsules contained in the plurality of toner particles with respect to an average particle diameter of the toner particles is equal to or greater than 10% and equal to or smaller than 50%.

9. The toner according to claim 1, wherein a content ratio of the microcapsules in the plurality of toner particles is equal to or greater than 1 weight % and equal to or smaller than 15 weight %.

10. The toner according to claim 1, wherein the plurality of toner particles further contain a coloring material.

11. A method for manufacturing a toner, comprising steps of:

mixing a first medium in which a plurality of microcapsules that contain a fragrant material is dispersed and a second medium in which a plurality of particles that contain a binder resin is dispersed to form a mixed medium;

causing aggregation of the microcapsules and the particles into a plurality of primary aggregate particles in the mixed medium;

mixing a third medium in which a plurality of particles that contain a binder resin is dispersed into the mixed medium; and causing aggregation of the particles contained in the third medium and the primary aggregate particles into a plurality of toner particles, wherein a ratio of a number of toner particles that contain at least one microcapsule in a region from a surface thereof to 1 μm in depth with respect to a total number of the toner particles is equal to or greater than 60%.

12. The method according to claim 11, wherein a content ratio of the particles of the third medium with respect to the toner particles is equal to or greater than 25% and equal to or smaller than 65%.

13. The method according to claim 11, wherein the ratio is equal to or greater than 80%.

14. The method according to claim 11, wherein a second ratio of a number of toner particles that contain two or more microcapsules exposed on a surface thereof with respect to a total number of the toner particles is equal to or smaller than 10%.

15. The method according to claim 14, wherein the second ratio is equal to or smaller than 5%.

16. The method according to claim 11, wherein the particles dispersed in the second medium further contain a coloring material.

17. An image forming apparatus, comprising:

a first image forming unit configured to form first toner particles to be transferred to a sheet, each of the first toner particles containing a binder resin and a coloring material;

a second image forming unit configured to form second toner particles to be transferred to the sheet, each of the second toner particles containing a binder resin and one or more microcapsules that contain a fragrant material; and a fixing unit configured to fix the first toner particles and the second toner particles on the sheet, wherein a ratio of a number of second toner particles that contain at least one microcapsule in a region from a surface thereof to 1 μm in depth with respect to a total number of the second toner particles is equal to or greater than 60%.

18. The image forming apparatus according to claim 17, wherein the second toner particles also contains a coloring material having a color different from the coloring material contained in the first toner particles.

19. The image forming apparatus according to claim 17, wherein the second toner particles are formed over the first toner particles on the sheet.

20. The image forming apparatus according to claim 17, wherein a ratio of a number of second toner particles that contain two or more microcapsules exposed on a surface thereof with respect to a total number of the second toner particles is equal to or smaller than 10%.

* * * * *